United States Patent [19]

Duclos

[11] Patent Number: 4,463,505

[45] Date of Patent: Aug. 7, 1984

[54] SOLE

[75] Inventor: Gary P. Duclos, Southbridge, Mass.

[73] Assignee: Joseph M. Herman Shoe Co., Inc., Cambridge, Mass.

[21] Appl. No.: 423,631

[22] Filed: Sep. 27, 1982

[51] Int. Cl.[3] ..... A43B 13/12; A43B 13/00; A61F 5/14

[52] U.S. Cl. ..... 36/30 R; 36/25 R; 128/610; 128/619

[58] Field of Search ..... 36/25 R, 30 R, 32 R, 36/91, 92, 108, 76 C, 44, 37, 71, 30 A, 107; 128/590, 610, 619, 621, 622, 623

[56] References Cited

U.S. PATENT DOCUMENTS

| | | | |
|---|---|---|---|
| 1,343,450 | 6/1920 | Haskell | 36/30 R |
| 1,675,206 | 6/1928 | Bell | 36/37 |
| 1,738,929 | 12/1929 | Simon | 128/610 |
| 2,049,604 | 8/1936 | Cristallini | 36/108 |
| 2,093,472 | 9/1937 | Nutt | 36/76 C |
| 2,188,225 | 1/1940 | Lawandus | 128/623 |
| 2,255,100 | 9/1941 | Brady | 36/37 |
| 2,917,757 | 12/1959 | Scholl | 128/619 |
| 4,353,173 | 10/1982 | Paquet | 36/77 R |

FOREIGN PATENT DOCUMENTS

| | | | |
|---|---|---|---|
| 734661 | 3/1943 | Fed. Rep. of Germany | 36/8.5 |

*Primary Examiner*—Werner H. Schroeder
*Assistant Examiner*—Steven N. Meyers

[57] ABSTRACT

An improved sole for footwear comprising an insole unit having an axially extending surface and a peripheral rib projecting downwardly from the surface for stitching the insole to the upper of the footwear, a midsole attached to the insole, the insole and midsole defining the top and bottom surfaces of a cavity, the cavity being bounded about its periphery by the rib, and an outsole attached to the midsole, the improvement comprising an orthotic element mounted in the cavity, the orthotic element comprising an axially extending flexible support layer.

16 Claims, 5 Drawing Figures

SOLE

BACKGROUND OF THE INVENTION

This invention relates to soles for footwear.

Orthotics are often used in boots and other types of outdoor footwear to provide support and to enhance comfort. Conventionally, orthotics are removable devices which are inserted into the footwear above the innersole directly beneath the user's foot. Such orthotics are often not comfortably accommodated in the foot space provided in a conventional upper and once inserted do not remain fixed in proper position during use.

SUMMARY OF THE INVENTION

In general, the invention features an improved sole for footwear comprising an insole unit having an axially extending surface and a peripheral rib projecting downwardly from the surface for stitching the insole to the upper of the footwear, a midsole attached to the insole, the insole and midsole defining the top and bottom surfaces of a cavity, the cavity being bounded about its periphery by the rib, and an outsole attached to the midsole, the improvement comprising an orthotic element mounted in the cavity, the orthotic element having an axially extending flexible support layer. This positioning of the orthotic provides a muted effect which results in greater comfort and at the same time fixes the orthotic in place as a permanent part of the footwear.

In preferred embodiments, the orthotic element further comprises a metatarsal support, the metatarsal support comprising a raised area in the flexible support layer, the raised area being anatomically shaped to conform to the entire metatarsal area of the foot; the raised area rises gradually from its periphery to a maximum height at its center; the maximum height of the raised area is on the order of 1/32 inch; the support layer is PVC; the orthotic element further comprises a heel cradle, the heel cradle comprising a depressed area in the support layer, the depressed area being anatomically shaped to conform to the heel of the foot; the orthotic element further comprises a rigid shank mounted on the flexible support layer; the flexible support further comprises a cavity adapted to receive the shank; and the shank is tempered stainless steel.

In another aspect the invention features a sole for footwear comprising an insole unit, the insole unit comprising an axially extending insole board, a peripheral ply-rib projecting downwardly from the insole board, an insole support layer overlying the insole board, an insole cover layer overlying the insole support layer, and a cup attached to the insole board in the heel area, the cup having a foam heel element, and a fabric heel cover overlying the foam element, a midsole attached to the insole, the insole and midsole defining the top and bottom surfaces of a cavity, the cavity being bounded on the periphery by the ply-rib, an orthotic element mounted in the cavity, the orthotic element comprising an axially extending flexible support layer, and a metal shank mounted on the flexible support layer, and an outsole attached to the midsole.

In preferred embodiments the insole board is Texon compressed paper board; the insole support layer is EVA; the cover layer is Thermaflex K three-dimensional woven nylon material; the midsole is No. 4 iron rubber; the flexible support layer is PVC, the shank is tempered stainless steel; the outsole is blown EVA; the insole board has transversely extending flexibility slashes cut into the underside of the metatarsal area; the midsole has perforations in its metatarsal area; the the perforations are rectangular in shape and are oriented in transversely staggered rows. Such an insole provides improved air circulation and insulation and produces a desirable "bouncing" effect which stimulates the foot, and at the same time provides a firm support which maintains its shape during use.

Other features and advantages of the invention will be apparent from the following description of the preferred embodiment, and from the claims.

DESCRIPTION OF THE PREFERRED EMBODIMENT

We first briefly describe the drawings.

DRAWINGS

STRUCTURE

Figure 1:
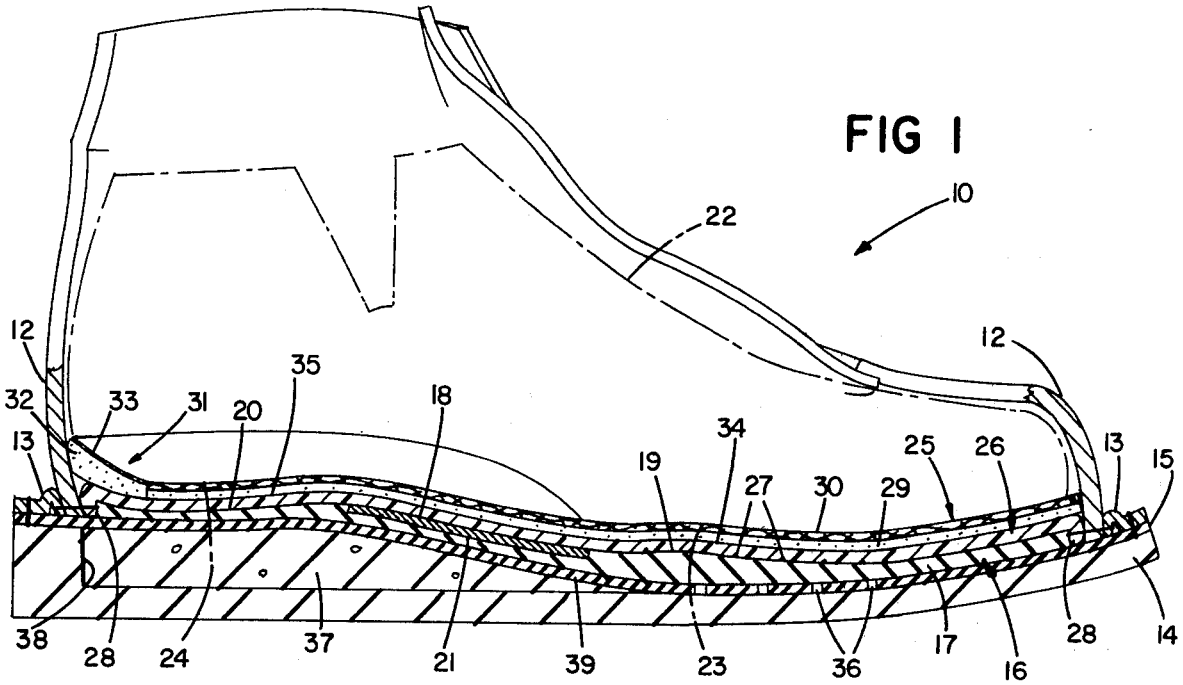
FIG. 1 is a vertical sectional view of a boot embodying the invention.

There is shown in FIG. 1 a boot 10 comprising an upper 12, an outsole 14, a midsole 15, an orthotic element 16, and an insole unit 25.

Figure 3:
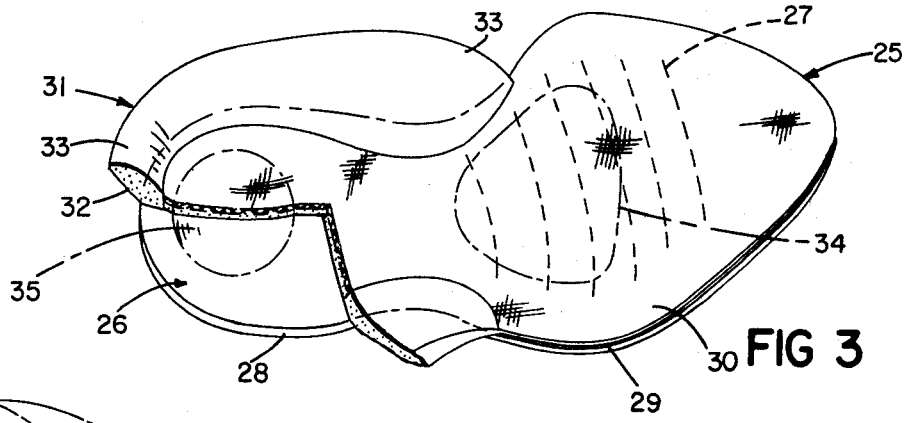
FIG. 3 is a perspective view, partially cut away, of an insole unit of the sole assembly.

Insole unit 25 (FIG. 3) comprises a Texon compressed paper board insole board 26 having transverse flexibility slashes 27 cut into the underside of its metatarsal area and 3/16-inch downwardly extending peripheral ply-rib 28 (3/64-inch thick fiber board covered with drill material), a support layer 29 of ⅛-inch thick EVA Sport Foam closed cell blown rubber, a cover layer 30 of Uniroyal Thermaflex K three-dimensional woven material, and a heel cup 31 having foam layer 32 of ⅛-inch thick, 6 lb. density Urethane E-Foam open cell urethane foam, and a cover 33 of Cambrelle woven polyester blend fabric.

Figure 2:
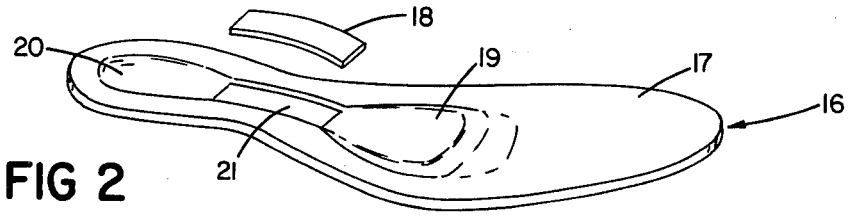
FIG. 2 is a perspective view of an orthotic element of the sole assembly of the boot.

Orthotic element 16 (FIG. 2) comprises a support layer 17 of 3/16-inch thick, 40 durameter blown PVC, having depressed heel cradle 20, cavity 21 adapted to receive tempered stainless steel shank 18, and raised metatarsal support 19 which rises gradually from its periphery toward its middle to an exaggerated 1/32-inch to form an anatomically shaped domed area which conforms to and supports the entire metatarsal area of the foot.

Midsole 15 (FIG. 5) comprises a 1/16-inch thick layer 39 of No. 4 iron rubber having transversely staggered rows of perforations 36 in its metatarsal area.

Figure 5:
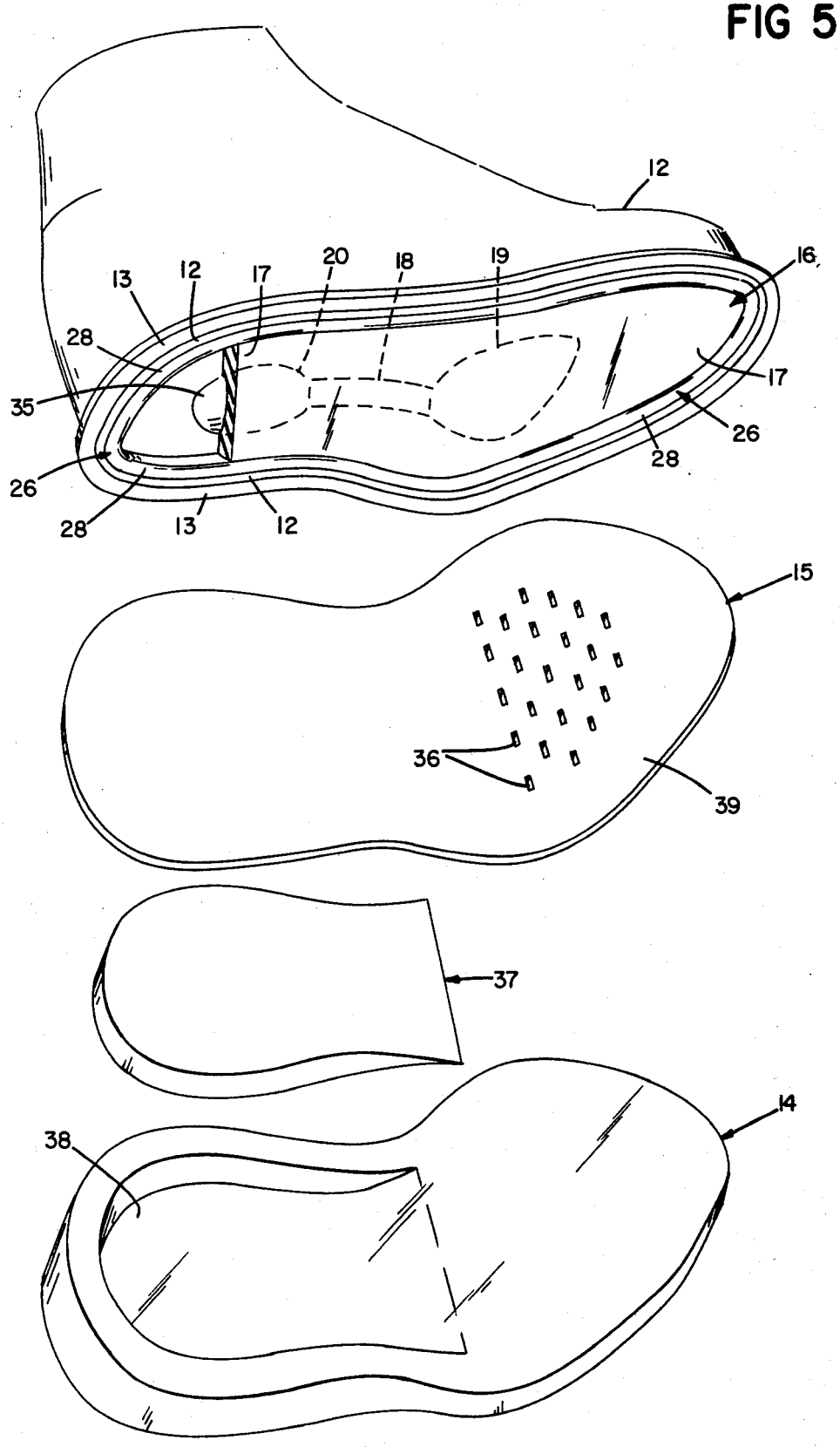
FIG. 5 is an exploded view, partially cut away, of the sole assembly.

As best shown in FIG. 5, outsole 14 of blown EVA, has a cavity 38 adapted to receive a heel insert 37 of EVA Shock Foam closed cell blown rubber.

MANUFACTURE

The surfaces of the elements of insole unit 25 (insole board 26, support layer 29, cover layer 30, and heel cup 31) are sprayed with a suitable adhesive (for example, No. 1693 Urethane cement) and the unit is then bonded together by conventionally available high frequency flow molding (for example, as provided by Compo Industries of Waltham, Mass.). During flow molding insole board 26 is impressed to form metatarsal and heel contours, 34, 35 adapted to conform to metatarsal support 19 and heel cradle 20, respectively.

Figure 4:
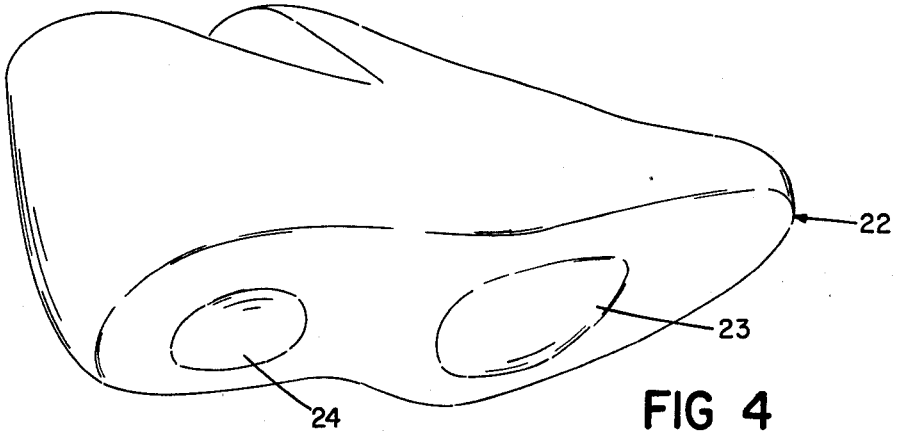
FIG. 4 is a perspective view of a molded last used in manufacturing the boot.

Upper 12 is then fitted over last 22 (FIG. 4) which has contours 23, 24 adapted to receive metarsal support 19 and heel cradle 20 of orthotic element 16, respectively. Insole unit 25 is then fastened to upper 12 and welt 13 by conventional Goodyear welt stitching (FIG. 5). Tempered stainless steel shank 18 is mounted in cavity 21 of support layer 17 and orthotic element 16 is then mounted with a conventional hot melt cement in the cavity formed by the downwardly extending ply-rib 28 of insole unit 25 (FIGS. 1 and 5). Midsole 15 is then cemented into place and stitched onto welt 13 (FIG. 1). Heel insert 37 is cemented into cavity 38 of outsole 14, which is then cemented onto the midsole.

Other embodiments are within the following claims.

I claim:

1. In a sole for footwear comprising:

an insole unit having an axially extending surface and a peripheral rib projecting downwardly from said surface for stitching said insole unit to the upper of the footwear, a midsole attached to said insole unit, said insole unit and midsole defining the top and bottom surfaces of a cavity therebetween, said cavity being bounded about its periphery by said rib, and an outsole attached to said midsole, the improvement comprising an orthotic element mounted in said cavity, said orthotic element comprising an axially extending flexible support layer, a metatarsal support comprising a raised area in said flexible support layer, said raised area being anatomically shaped to conform to the entire metatarsal area of the foot, and a heel cradle comprising a depressed area in said support layer, said depressed area being anatomically shaped to conform to the heel of the foot.

2. The improved sole of claim 1 wherein said raised area rises gradually from its periphery to a maximum height at its center.

3. The improved sole of claim 2 wherein the maximum height of said raised area is on the order of 1/32 inch.

4. The improved sole of claim 1 wherein said support layer is PVC.

5. The improved sole of claim 1 wherein said orthotic element further comprises, a rigid shank mounted on said flexible support layer.

6. The improved sole of claim 5 wherein said support layer further comprises a cavity adapted to receive said shank.

7. The improved sole of claim 5 wherein said shank is tempered stainless steel.

8. A sole for footwear comprising:

an insole unit, said insole unit comprising an axially extending insole board, a peripheral ply-rib projecting downwardly from said insole board, an insole support layer overlying said insole board, an insole cover layer overlying said insole support, and a cup attached to said insole board in the heel area thereof, said cup having a foam heel element and a fabric heel cover overlying said foam element, a midsole attached to said insole unit, said midsole and insole unit defining the top and bottom surfaces of a cavity therebetween, said cavity being bounded on its periphery by said ply-rib, an orthotic element mounted in said cavity, said element comprising an axially extending flexible support layer, and a rigid shank mounted on said flexible support layer, and an outsole attached to said midsole.

9. The sole of claim 8 wherein said insole board is Texon compressed paper board, said insole support layer is EVA Sport Foam closed cell blown rubber material, and said insole cover layer is Thermaflex K three-dimensional woven nylon material.

10. The sole of claim 8 or 9 wherein said midsole is No. 4 iron rubber.

11. The sole of claim 8, wherein said support layer is PVC and said shank is tempered stainless steel.

12. The sole of claim 11 wherein said outsole is blown EVA.

13. The sole of claim 10 wherein said insole board has transversely extending flexibility slashes cut into the underside of its metatarsal area.

14. The sole of claim 8 wherein said midsole has perforations in its metatarsal area.

15. The sole of claim 14 wherein said perforations are rectangular in shape and are oriented in transversely staggered rows.

16. The sole of claim 8 wherein said flexible support layer further comprises a cavity to receive said rigid shank.

* * * * *